US006230531B1

(12) United States Patent
Tezuka et al.

(10) Patent No.: US 6,230,531 B1
(45) Date of Patent: May 15, 2001

(54) ROLLING DATA COLLECTING METHOD AND SYSTEM

(75) Inventors: Tomoyuki Tezuka, Fuchu; Noriyasu Okitani, Urawa, both of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/453,712

(22) Filed: Dec. 3, 1999

(30) Foreign Application Priority Data

Dec. 3, 1998 (JP) ..... 10-344631

(51) Int. Cl.[7] ..... B21B 37/00

(52) U.S. Cl. ..... 72/8.3; 72/8.8; 72/11.1; 72/11.5; 72/12.5

(58) Field of Search ..... 72/8.1, 8.3, 8.4, 72/8.8, 11.1, 11.2, 11.5, 12.5

(56) References Cited

U.S. PATENT DOCUMENTS 5,860,304 1/1999 Anbe et al. ..... 72/9.1

FOREIGN PATENT DOCUMENTS 63-119922 * 5/1988 (EP) ..... 72/12.5
59-76614 * 5/1984 (JP) ..... 72/12.5
2-37910 * 2/1990 (JP) ..... 72/12.5
2-187210 * 7/1990 (JP) ..... 72/12.5
6-292915 * 10/1994 (JP) ..... 72/12.5
7-16624 1/1995 (JP) .

* cited by examiner

*Primary Examiner*—Ed Tolan
(74) *Attorney, Agent, or Firm*—Foley & Lardner

(57) ABSTRACT

The rolling data collecting system according to this invention collects rolling data of a rolled strip to be serially rolled through a tandem rolling mill, using the first rolling data measuring means installed at each roll stand and the second rolling data measuring means installed in the rolling line. The measuring point decision means decides a measuring point on a rolled strip which is used for measuring data by the first and second rolling data measuring means. The tracking means detects that the decided measuring point has reached each roll stand locating from the entry side of the tandem rolling mill and to the delivery side thereof, and the location of the second rolling data measuring means. Every time when the measuring point reaches each roll stand and the second rolling data measuring means, the rolling data collecting means collects the rolling data of the rolled strip or rolled strip measured by the first and second rolling data measuring means.

22 Claims, 4 Drawing Sheets

ROLLING DATA COLLECTING METHOD AND SYSTEM

BACKGROUND OF THE INVENTION

1. Field of the Invention

This invention relates to a rolling data collecting method and system to be used for a tandem hot rolling mill.

2. Related Background Art

So far, collecting of rolling data in a tandem hot rolling mill has been made as follows: The rolling data measuring devices installed for all of the roll stands in the tandem hot rolling mill collected rolling data simultaneously at a timing when a point on the rolled strip a few or several meters away from the leading (or trailing) edge of the rolled strip just enters the stands.

According to the prior art, all rolling data generated at all of the stands are collected at the same timing, so that the obtained rolling data can be said to represent no recognition or consideration for the past rolling history of the rolled strip, thereby resulting in a possible inaccuracy when making the analysis of rolling mechanism or the learning of established calculation method using these rolling data.

SUMMARY OF THE INVENTION

In view of the aforementioned problems, this invention intends to provide a rolling data collecting method and system which can enhance the analysis of rolling mechanism or the learning of established calculation method.

Further, the invention intends to provide a rolling data collecting method and system which can produce a high accuracy of analysis of rolling mechanism, using the rolling data obtained.

Furthermore, the invention intends to provide a rolling data collecting method and system which can enhance the accuracy of the setting and learning for the subsequent sheet and on forward by way of already collected rolling data.

To achieve these above-described purposes, the rolling data collecting method according to the invention which collects rolling data of a rolled strip to be serially rolled by a tandem rolling mill, using a first rolling data measuring means provided at every roll stand and a second rolling data measuring means provided in the rolling line, the method comprising the steps of;

deciding a data-measuring point of a rolled strip by way of the first and second rolling data measuring means;

detecting that the above-decided data-measuring point has reached each stand and the installation position of the second rolling data measuring means; and collecting the rolling data measured by the first and second rolling data measuring means, every time when the measuring point reached each stand and the second rolling data measuring means.

In other words, using this rolling data collecting method according to the invention, the data-measuring point of a rolled strip is decided by way of the first and second rolling data measuring means, whether the above-decided data-measuring point has reached the every stand and the installation point of the second rolling data measuring means is detected and then the rolling data measured by the first and second rolling data measuring means are collected, every time when the measuring point reached the every stand and the second rolling data measuring means.

Further, the rolling data collecting system according to the invention comprises:

first rolling data measuring means provided at each stand installed from the entry side to the delivery side for obtaining rolling data of a rolled strip to be serially rolled;

second rolling data measuring means provided in the rolling line for obtaining rolling data of the rolled strip;

measuring point decision means for deciding a measuring point on the rolled strip for obtaining rolling data using the first and second rolling data measuring means;

tracking means for detecting that the measuring point has reached each roll stand and the installation position of the second rolling data measuring means; and rolling data collecting means for obtaining the rolling data measured by the first and second rolling data measuring means every time when the measuring point has reached each stand and the installation position of the second rolling data measuring means.

The second rolling data measuring means may be installed at the delivery side of the tandem rolling mill, so that the measuring point decision means can select (as the suitable measuring point on the rolled strip) the rolling point of the rolled strip at the leading stand, which takes place just at the timing when the leading edge of the rolled strip reached the second rolling data measuring means.

Otherwise, the second rolling data measuring means may be installed at the delivery side of the tandem rolling mill, so that the measuring point decision means can select (as the measuring point on the rolled strip) the rolling point of the rolled strip at the leading stand, which takes place a preset time after the timing when the leading edge of the rolled strip reached the second rolling data measuring means.

The measuring point decision means may select the rolling point of the rolled strip at the leading stand, which takes place a preset time after the time when the leading edge of the rolled strip reached the leading stand, as the measuring point on the rolled strip.

The measuring point decision means may select a point (on a rolled strip) a preset distance away from the leading edge of a rolled strip as the measuring point on the rolled strip.

The measuring point decision means may select a point on a rolled strip as the first measuring point, and then select the rolling point of the rolled strip at the leading stand, which takes place when the first measuring point reached the second rolling data measuring means, as the second measuring point. This procedure is repeated until the rolling operation finishes.

The measuring point decision means may select a point on a rolled strip as the first measuring point, and then select the rolling point of the rolled strip at the leading stand, which takes place a preset time after the timing when the first measuring point reached the second rolling data measuring means, as the second measuring point. This procedure is repeated until the rolling operation finishes.

The tracking means may follow the track of a measuring point on a rolled strip, using a pulse value of a pulse generator at least connected to the motor driving the rolling mill, the roll diameter and forward slip.

The tracking means may follow the track of a measuring point on a rolled strip, using a pulse value of a pulse generator connected to the motor driving the trailing stand, the roll diameter and forward slip, as well as the thickness of the strip at the delivery side of the trailing stand, and the delivery-side thickness of the rolled strip at the measuring point under tracking.

The tracking means may decide how far the measuring point on a rolled strip advanced from the leading stand, using the sheet thickness at the entry and delivery sides of a roll stand, when the tracking means judged that the measuring point on the rolled strip reached the roll stand.

The tracking means may correct the tracking position for the measuring point on a rolled strip, using the distance how far the sheet advanced from the leading stand.

The tracking means may decide reaching times to the rolling mill and the second rolling data measuring means, using the peripheral speed and forward slip of the roll, stand spacing, and the distance between the rolling mill and the second rolling data measuring means. A setting of the calculated reaching times to a timer can follow the track of the measuring point of the rolled strip.

The second rolling data measuring means may be installed at the entry side of a tandem rolling mill. The measuring point decision means selects a point on a rolled strip locating at the second rolling data measuring means as long as the measurements of the rolled strip by the second rolling data measuring means fall into a preset range during a preset period.

When measurements of the second rolling data measuring means keep the preset range after the decision of the measuring point, the measuring point decision means selects the point on a rolled strip locating at the second rolling data measuring means as the measuring point, with a preset cycle period.

The second rolling data measuring means may be installed between stands. The measuring point decision means selects a rolling point on a rolled strip locating at the leading stand as the measuring point, as long as the measurements of the rolled strip by the second rolling data measuring means fall into a preset range during a preset period.

In a case after the decision of the measuring point has been made and when the measurements of a rolled strip given by the second rolling data measuring means fall into a preset range, the measuring point decision means selects the rolling point on the sheet at the leading stand as the measuring point, with a preset cycle period.

The second rolling data measuring means may be installed at the delivery side of the tandem rolling mill, so that the measuring point decision means selects the rolling point on the sheet at the leading stand as the measuring point, when the measurements of the strip given by the second rolling data measuring means fall in a preset range for a preset period.

In a case after the decision of the measuring point has been made and when the measurements of the strip given by the second rolling data measuring means continue to fall into a preset range, the measuring point decision means selects the rolling point on the sheet at the leading stand as the measuring point, with a preset cycle period.

The second rolling data measuring means may include at least one of a strip crown meter, temperature gage, strip width meter and flatness meter.

DESCRIPTION OF THE PREFERRED EMBODIMENT

Figure 1:
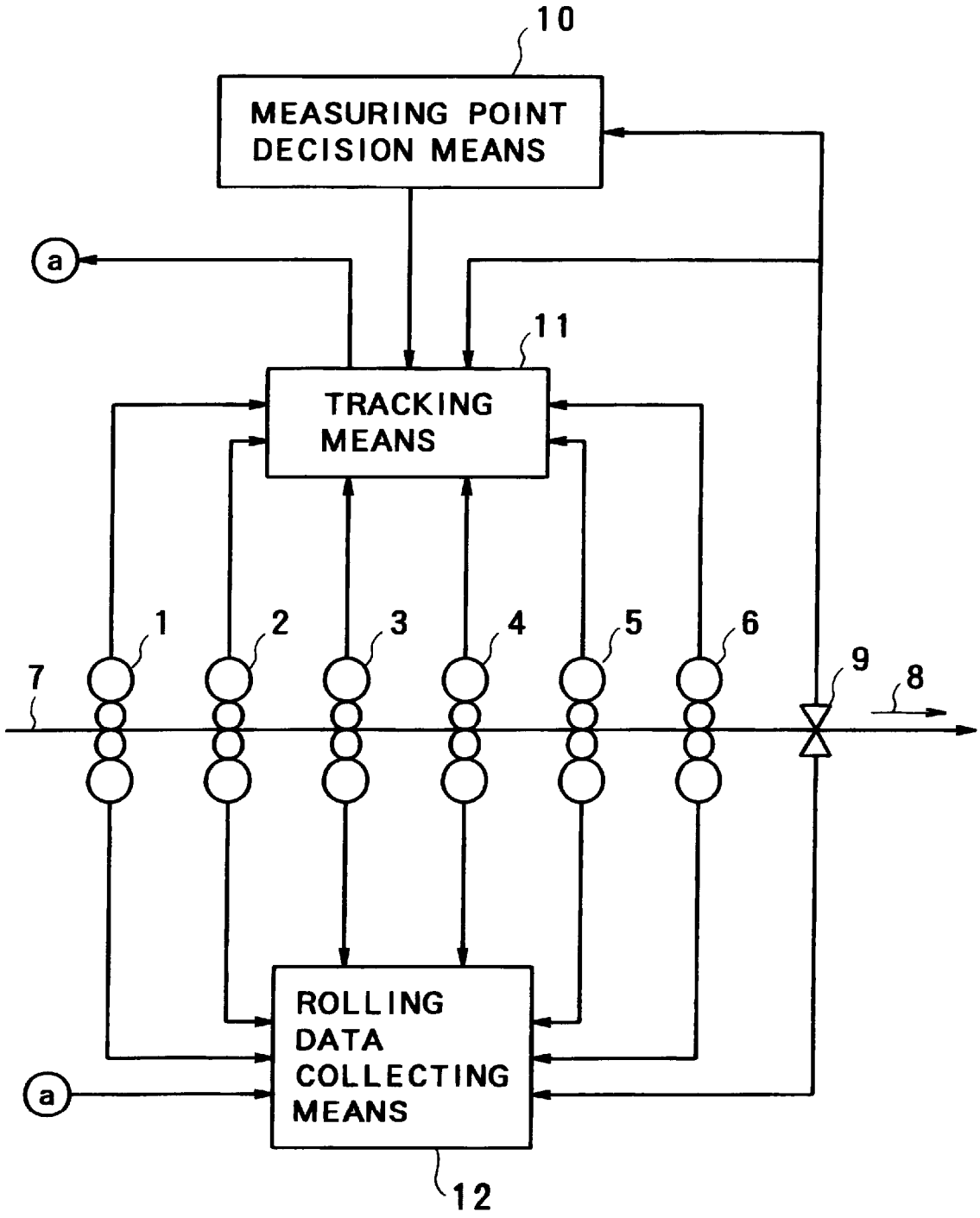
FIG. 1 is the schematic block diagram showing the first embodiment of the rolling data collecting system which executes the rolling data collecting method according to the present invention, inclusive of an applicable rolling mill.

Referring to the preferred embodiments shown in the attached drawings, detail description will be made for the present invention:

FIG. 1 is the schematic block diagram showing the first embodiment of the rolling data collecting system which carries out the rolling data collecting method according to the invention, inclusive of an applicable tandem rolling mill. In the drawing, the tandem rolling mill consists of six roll stands (stand 1~6) serially arranged. The stand locating at the entry side is called the first or leading stand, and the stand locating at the delivery side is called the sixth or trailing stand. A rolled strip 7 is rolled into a strip in the direction of an arrow 8. Each stand is provided with the first rolling data measuring means or device (not shown) to measure rolling load, bending force, pair cross angle, roll coolant flow rate and other rolling data.

The second rolling data measuring means or device is installed at the entry or delivery side of the tandem rolling mill, or in between the roll stands to measure the temperature, thickness, width, sheet crown, flatness and length of a rolled strip, coolant flow rate and other rolling data.

Here, for simplification of the drawing and description, only a sheet crown meter 9 to be used for measuring the sheet crown is shown instead of the variety of above-described measuring devices. Now,description will be made for the operation of the measuring point decision means or device 10 according to the first embodiment to decide the measuring point on a rolled strip, referring to the measurements of the sheet crown meter 9 as an example:

First, a rolled strip enters the tandem rolling mill, and advances from the first stand 1 to the sixth stand 6 while serially rolled. When the sheet 7 reached the sheet crown meter 9, the measuring point decision means 10 selects a point on the rolled strip being rolled in the first stand 1 as the first measuring point. Depending on a case, however, the sheet crown control may be executed at the timing when the sheet 7 reached the sheet crown meter 9. In such a case, the operation made by the rolling data collecting means or device 12 may result in collection of transient rolling data. To prevent such improper decision, the measuring point decision means 10 may select a point on the rolled strip just locating at the first stand 1 as the first measuring point, a fraction of second (e.g., 0.5 sec) after the strip 7 reached the sheet crown meter 9.

The tracking means 11 keeps the track of the measuring point decided by the measuring point decision means 10 from the first stand 1 to the sixth stand 6. There are such two types of tracking methods as follows:

The first tracking method:

In general, the motors for driving roll stands 1, 2, . . . , 6 are connected directly or wired to a pulse generator. Now, the number of pulses generated by the pulse generator is abbreviated as the pulse value of motor.

Before a rolled strip 7 enters the tandem rolling mill, the tracking means 11 calculates a pulse value of each motor which is necessary for the rolled strip 7 to advance in between roll stands and between a roll stand and the rolling data measurement device. For example, the pulse value $\overline{p_1}$ of the motor for the first stand 1 which is necessary for the rolled strip 7 to advance from the first roll stand 1 to the second roll stand 2 is decided so as to satisfy the following expression:

$$\pi \cdot \frac{\overline{p_1}}{p_1}(1+f_1)\cdot d_1 \cdot g_1 = l_{12} \tag{1}$$

where $p_1$: pulse value when the first stand motor makes one rotation $f_1$: forward slip of the first stand $d_1$: diameter of work roll of the first stand $g_1$: gear ratio of the first stand $l_{12}$: distance between the first and second stands.

In this connection, the forward slip $f_1$ is calculated using pass schedule and other factors by a calculation processing unit (not shown). Work roll diameter, gear ratio and distance between the first and second stands are known.

When the rolled strip 7 entered the tandem rolling mill, and the measuring point on the sheet 7 reaches the first stand 1 the tracking means 11 sets the pulse value $\overline{p_1}$ of the first stand motor calculated by the expression (1) to the relevant pulse generator. When the first stand motor rotates just one pulse value $\overline{p_1}$, the rotation is noticed to the tracking means 11 from the pulse generator. Receiving the notice, the tracking means 11 judges that the measuring point on the sheet 7 reached the second stand 2.

When the measuring point on the sheet 7 reached the second stand 2, similarly in the case of the first stand 1 the tracking means 11 sets the pulse value $\overline{p_2}$ of the second stand motor to the relevant pulse generator. When the second stand motor rotates just one pulse value $\overline{p_2}$, the rotation is noticed to the tracking means 11 from the pulse generator. Receiving the notice, the tracking means 11 judges that the measuring point on the sheet 7 reached the third stand 3.

Similar operation is repeated until the measuring point on the sheet or strip reaches the strip crown meter 9 installed at the delivery side of the tandem rolling mill. These sequential operations can keep the track of the measuring point on the sheet 7 from the first stand 1 up to the strip crown meter 9.

The above described the case where the measuring point on the rolled strip 7 is kept tracked from the first stand 1. There may be a case where tracking of the measuring point on the rolled strip 7 starts before entering the first stand 1. In this case, backward slip which is calculated using the expression (1) may be used in place of forward slip, where the expression (1) must be rewritten by backward slip. In a case where a pinch roll or a measuring roll is installed in front of the tandem rolling mill, the pulse value of the pulse generator for this pinch roll or measuring roll also can be used for tracking, thus considerably enhancing the tracking accuracy.

The second tracking method:

Before the rolled strip 7 enters the tandem rolling mill, the tracking means 11 calculates the pulse value of the sixth stand motor which is necessary for the sheet 7 to advance in between roll stands and between a roll stand and the rolling data measurement device. For example, the pulse value $\overline{p_{61}}$ of the sixth stand motor which is necessary for the rolled strip 7 to advance from the first roll stand 1 to the second roll stand 2 is decided so as to satisfy the following expression:

$$\pi \cdot \frac{\overline{p_{61}}}{p_6}\cdot(1+f_6)\cdot d_6 \cdot g_6 \cdot \frac{h_6}{h_1} = l_{12} \tag{2}$$

where $p_6$: pulse value when the sixth stand motor makes one rotation $f_6$: forward slip of the sixth stand $d_6$: diameter of work roll of the sixth stand $g_6$: gear ratio of the sixth stand $h_6$: the thickness of the strip at the delivery side of the sixth stand $h_1$: the thickness of the rolled strip at the delivery side of the first stand $l_{12}$: distance between the first and second stands.

In this connection, the forward slip is calculated using pass schedule and other factors by a calculation processing unit (not shown). Work roll diameter, gear ratio and distance between the stands are known. The sheet thickness of the rolled strip or strip 7 can be estimated using e.g., gauge meter and the like.

When the sheet 7 entered the tandem rolling mill, and then the measuring point on the sheet 7 just reached the first stand 1 the tracking means 11 sets the pulse value $\overline{p_{61}}$ of the sixth stand motor calculated by the expression (2) to the pulse generator for the sixth stand motor. When the sixth stand motor rotated the pulse value $p_{61}$, receiving the notice from the pulse generator, the tracking means 11 judges that the measuring point on the sheet 7 reached the second stand 2.

When the measuring point on the sheet 7 just reached the second stand 2, similarly to the case in the first stand 1 the tracking means 11 sets the pulse value $\overline{p_{62}}$ of the sixth stand motor to the pulse generator for the sixth stand motor. When the second stand motor just rotated the pulse value $\overline{p_{62}}$, receiving the notice from the pulse generator, the tracking means 11 judges that the measuring point on the sheet 7 reached the third stand 3.

Similar operation is repeated until the measuring point on the sheet or strip reaches the strip crown meter 9 installed at the delivery side of the tandem rolling mill. These sequential operations can keep the track of the measuring point on the sheet 7 from the first stand 1 up to the strip crown meter 9.

However, both the above-described methods must issue an notice from the pulse generator every time when the motor rotates just the pulse value, thereby increasing the system cost, thus resulting in a possibility of losing their application. Therefore, description will be made for a more cost-effective system where motor pulse value is just counted.

In the above case, the tracking means 11 measures motor pulse value at a certain sampling interval of period, to accumulate the differences between the preceding pulse value and the current pulse value. For example, when the measuring point on the sheet 7 reached the first stand 1 according to the first method, the tracking means 11 clears the accumulated pulse value at the first stand 1 to zero, and then, from the next measuring timing, independently calculates a difference between the preceding pulse value and the current pulse value, to accumulate the differences. In other words, when the measuring point on the sheet 7 reached the first stand 1 the calculation of the following expression (3) is started.

$$p_{1i}=\Sigma(p_{1p}-p_{1pre}) \tag{3}$$

where $p_{1t}$: accumulated value of the differences of the pulse values of the first stand motor $p_{1p}$: current pulse value of the first stand motor $p_{1pre}$: preceding pulse value of the first stand motor.

In the case of the second method also, similarly the tracking means 11 clears the accumulated pulse value at the sixth stand 6 to zero, and then, when the measuring point on the sheet 7 reached the first stand 1 the calculation of the following expression (4) is started.

$$p_{6t1}=\Sigma(p_{6p1}-p_{6pre1}) \tag{4}$$

where $p_{6t1}$: accumulated value of the differences of the pulse values of the sixth stand motor $p_{6p1}$: current pulse value of the sixth stand motor $p_{6pre1}$: preceding pulse value of the sixth stand motor.

In this connection, in the case where the above expression (4) is calculated, the pulse values of the motor return to zero every time when the motor makes one rotation. According to the first method, at this moment, the calculation of the expression (3) is carried out using "$p_{1p}$" of the following expression (5) in place of the current pulse value $p_{1p}$ of the first stand motor.

$$\overline{p_{1p}}=p_{1p}+p_1 \tag{5}$$

On the other hand, according to the second method, at this moment, the calculation of the expression (4) is carried out using "$p_{6p1}$" of the following expression (6) in place of the current pulse value $p_{6p1}$ of the sixth stand motor.

$$\overline{p_{6p1}}=p_{6p1}+p_6 \tag{6}$$

where $p_1$: pulse value taken when the first stand motor make one rotation $p_6$: pulse value taken when the sixth stand motor make one rotation.

The tracking means 11 judges whether the measuring point on the rolled strip 7 has reached the second stand, using the motor pulse accumulated value $p_{1t}$ or $p_{6t}$ calculated using the expression (3) or (4) as follows:

According to the first method, when the expression (7) changes into the expression (8), where.

$$\pi\cdot\frac{p_{1t}}{p_1}\cdot(1+f_1)\cdot d_1\cdot g_1<l_{12} \tag{7}$$

$$\pi\cdot\frac{p_{1t}}{p_1}\cdot(1+f_1)\cdot d_1\cdot g_1\geq l_{12} \tag{8}$$

According to the second method, when the expression (9) changes into the expression (10), where $$\pi\cdot\frac{p_{6tl}}{p_6}\cdot(1+f_6)\cdot d_6\cdot g_6\cdot\frac{h_6}{h_1}<l_{12} \tag{9}$$

$$\pi\cdot\frac{p_{6tl}}{p_6}\cdot(1+f_6)\cdot d_6\cdot g_6\cdot\frac{h_6}{h_1}\geq l_{12} \tag{10}$$

the tracking means 11 judges that the measuring point on the sheet 7 reached the second stand 2.

In the above expressions, $p_1$: pulse value taken when the first stand motor makes one rotation $f_1$: forward slip of the first stand $d_1$: work roll diameter of the first stand $g_1$: gear ratio of the first stand $l_{12}$: distance between the first and second stands $p_6$: pulse value taken when the sixth stand motor makes one rotation $f_6$: forward slip of the sixth stand $d_6$: work roll diameter of the sixth stand $g_6$: gear ratio of the sixth stand $h_6$: thickness of rolled strip at the delivery side of the sixth stand $h_1$: thickness of rolled strip at the delivery side of the first stand.

In this connection, when the tracking means 11 judged that the measuring point on the rolled strip 7 reached the second stand 2 using (7) and (8) expressions or (9) and (10) expressions, in most instances the measuring point would have passed through the second stand 2. Tracking up to the strip crown meter 9 as it is may produce a significant error, so that the obtained track of the measuring point shall be corrected so as to prevent such a significant error from taking place.

When the measuring point on the sheet 7 advanced "L" from the first stand 1 and the tracking means 11 judged that the measuring point reached the second stand 2, L can be expressed by way of the first method in following expression (11):

$$L=\pi\cdot\frac{p_{1t}}{p_1}\cdot(1+f_1)\cdot d_1\cdot g_1 \tag{11}$$

while L can be expressed by way of the second method in following expression (12):

$$L=\pi\cdot\frac{p_{6tl}}{p_6}\cdot(1+f_6)\cdot d_6\cdot g_6\cdot\frac{h_6}{h_1} \tag{12}$$

Here, taking a change of the thickness of the rolled strip 7 into consideration, the measuring point would have arrived at a point "$L_1$" away from the second stand 2, where $L_1$ can be calculated using the following expression (13):

$$L_1=(L-l_{12})\cdot\frac{h_1}{h_2} \tag{13}$$

where

L: distance of measuring point from first stand $l_{12}$: spacing between first and second stands $h_1$: thickness of rolled strip at the delivery side of first stand $h_2$: thickness of rolled strip at the delivery side of second stand.

In other words, the distance $L_1$ calculated by (13) is an error to be produced when the tracking means 11 followed the track of the measuring point from the first stand 1 up to the second stand 2. Therefore, when the tracking means 11 follows the track of the measuring point from the second stand 2 up to the second stand 3, instead of similar expressions to (7) and (8) or (9) and (10), according to the first method, other expressions (14) and (15) are used taking the above-described correction caused by tracking into consideration, while according to the second method, other expressions (16) and (17) are used. Here, these expressions are as follows:

$$\pi \cdot \frac{p_{2t}}{p_2} \cdot (1 + f_2) \cdot d_2 \cdot g_2 \cdot < l_{23} - L_1 \tag{14}$$

$$\pi \cdot \frac{p_{2t}}{p_2} \cdot (1 + f_2) \cdot d_2 \cdot g_2 \cdot \geq l_{23} - L_1 \tag{15}$$

$$\pi \cdot \frac{p_{6t2}}{p_6} \cdot (1 + f_6) \cdot d_6 \cdot g_6 \cdot \frac{h_6}{h_2} < l_{23} - L_1 \tag{16}$$

$$\pi \cdot \frac{p_{6t2}}{p_6} \cdot (1 + f_6) \cdot d_6 \cdot g_6 \cdot \frac{h_6}{h_2} \geq l_{23} - L_1 \tag{17}$$

More particularly, according to the first method, when the condition of (14) changes into the condition of (14), the tracking means 11 judges that the measuring point has reached the third stand 3, while according to the second method, when the condition of (14) changes into the condition of (17), the tracking means 11 judges that the measuring point has reached the third stand 3.

Here, $p_{2t}$: accumulated value of the differences of pulse values of second stand motor $p_2$: pulse value when the second stand motor makes one rotation $f_2$: forward slip of second stand $d_2$: diameter of second stand work roll $g_2$: gear ratio of second stand $l_{23}$: distance between second and third stands $p_{6t2}$: accumulated value of the differences of pulse values of sixth stand motor $p_6$: pulse value when the sixth stand motor makes one rotation $f_6$: forward slip of sixth stand $d_6$: diameter of sixth stand work roll $g_6$: gear ratio of sixth stand $h_6$: strip thickness at the delivery side of sixth stand $h_2$: rolled strip thickness at the delivery side of second stand.

When the measuring point further advances from the third stand 3 to the fourth stand 4, and so on, similar correction as shown above are repeated, so that the tracking of the measuring point can be adequately kept without any error up to the strip crown meter 9.

On the other hand, when the rolling operation is made at a uniform speed without any acceleration or deceleration, time required for the rolled strip 7 to reach all of the roll stands or the rolling data measuring device is determined before the sheet 7 enters the tandem rolling mill, thereby allowing the timers to be used for following the track of the measuring point of the rolled strip 7. In the case where tracking is made from the first stand 1 up to the strip crown meter 9, time lengths which are required for the measuring point to reach them are determined using the following expressions (18), (19), (20), (21), (22) and (23):

$$t_2 = \frac{l_{12}}{V_1 \cdot (1 + f_1)} \tag{18}$$

$$t_3 = \frac{l_{23}}{V_2 \cdot (1 + f_2)} + t_2 \tag{19}$$

$$t_4 = \frac{l_{34}}{V_3 \cdot (1 + f_3)} + t_3 \tag{20}$$

-continued $$t_5 = \frac{l_{45}}{V_4 \cdot (1 + f_4)} + t_4 \tag{21}$$

$$t_6 = \frac{l_{56}}{V_5 \cdot (1 + f_5)} + t_5 \tag{22}$$

$$t_c = \frac{l_{6c}}{V_6 \cdot (1 + f_6)} + t_6 \tag{23}$$

where $t_i$ (i=2–6): time length required for measuring point to reach the ith stand to: time length required for measuring point to reach the strip crown meter $l_{ii+1}$ (i=2–6): distance between the ith stand and the (i+1) th stand $l^{6c}$: distance between the 6th stand and strip crown meter $v_i$ (i=2–6): peripheral speed of the work roll of the ith stand $f_i$ (i=2–6): forward slip of the ith stand.

Here, the distances between stands are known. Peripheral speed of the work roll and forward slip are calculated in an operational processing device (not shown), using pass schedule and the like.

When the measuring point reaches the first stand, the tracking means 11 sets the time lengths determined using the expressions (18) to (23) to the timer. When the rolling process so advances that each time length has passed, the tracking means 11 judges that the measuring point has reached respective corresponding stands or the rolling data measuring device. In the case when such timer setting is made, the control time required is so sooner that tracking accuracy is enhanced. In this connection, the above process description is made for the case where the tracking means 11 follows the track of the measuring point from the first stand up to the strip crown meter 9, but it may be quite evident that similar process can be applied for cases where the rolling data measuring device is located at the entry side of a tandem rolling mill, or between stands.

Now, description will be made for the operation performed by the measuring point decision means 10 when the measuring point reaches the strip crown meter 9:

When the measuring point reaches the strip crown meter 9, the measuring point decision means 10 selects a point on the rolled strip 7 locating at the first stand as the second measuring point, when, in a similar way to the one taken when the first measuring point is decided, the second measuring point may be decided after timer setting.

And then until the rolling operation is completely finished, same operations are repeated. In this connection, in the above description the measuring point on a rolled strip 7 is selected as its position just in contact with the rolls of the first stand 1 when the leading edge of the rolled strip 7 reached the strip crown meter 9, but a contact point on the rolled strip 7 which comes a fraction of second (e, g, 0.5 sec) later may be selected as the first measuring point, or otherwise a point three meter inside from the leading edge of the rolled strip 7 may be selected as the first measuring point.

Now, description will be made for the rolling data collecting means 12:

When the measuring point on a rolled strip 7 whose track the tracking means 11 is always following has reached respective locating positions of roll stands and the rolling data measuring device, the rolling data collecting means 12 collects the rolling load, bending force, pair cross angle, temperature, thickness, width, crown, flatness and other rolling data of the rolled strip or rolled strip. Now, description will be made for the operation of the rolling data collecting means 12.

As described previously, first, the measuring point decision means 10 decides a point on a rolled strip locating under the rolls of the first stand 1 as the measuring point. Then, the tracking means 11 starts tracking of the measuring point. When the measuring point reached the first stand 1 the tracking means 11 noticed that to the rolling data collecting means 12. Receiving the notice signal, the rolling data collecting means 12 collects the rolling load, bending force, pair cross angle and other rolling data of the rolled strip at the first stand 1 and stores them in its memory.

Then, the rolling operation advances further, and soon the measuring point reaches the second stand 2, when the tracking means 11 notices that to the rolling data collecting means 12. Receiving the notice signal, similarly to the case at the first stand 1 the rolling data collecting means 12 collects the rolling load, bending force, pair cross angle and other rolling data of the rolled strip at the second stand 2, and stores the data in its memory.

Similar operations to the above are repeated from the third stand 3 up to the sixth stand 6. Then, the rolling data collecting means 12 resulted in having collected all necessary rolling data at the measuring point on the rolled strip 7 from the first to sixth stands 1 to 6.

Finally, the measuring point on the rolled strip or rolled strip 7 reaches the strip crown meter 9 installed at the delivery side of the sixth stand 6. Here, similarly to the case at the first stand 1 the tracking means 11 notices that to the rolling data collecting means 12. Receiving the notice signal, the rolling data collecting means 12 collects the measurements of the strip crown meter 9 as rolling data and stores the data in its memory.

As an alternative way, every time when the measuring point on a rolled strip 7 reaches rolling data measuring devices (not shown), similarly to the above description, the tracking means 11 may give the rolling data collecting means 12 that reaching notices. Receiving the notice, the rolling data collecting means 12 collects the measurements of the rolling data measurement devices as rolling data and stores the data in its memory.

Figure 2:
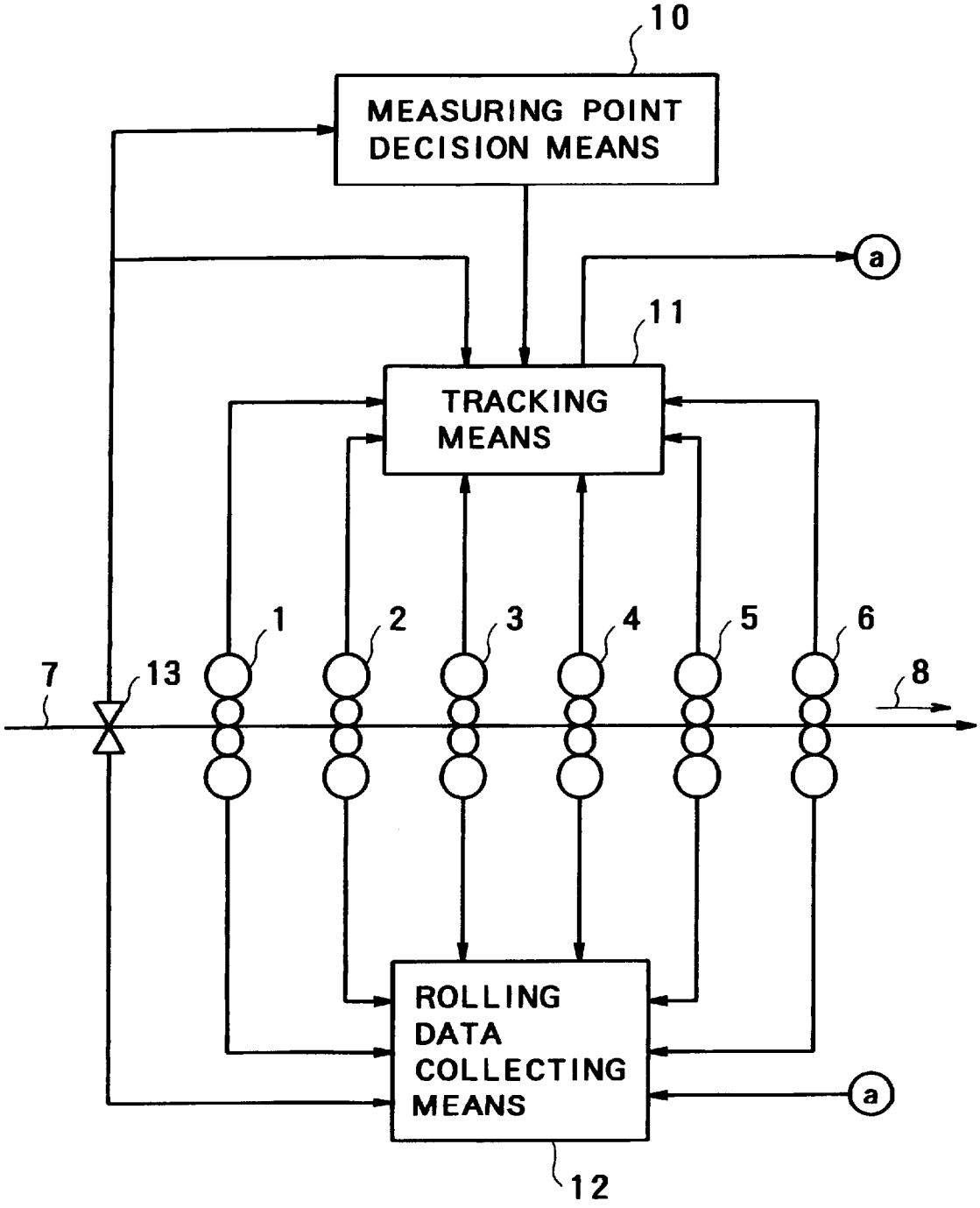
FIG. 2 is the schematic block diagram showing the second embodiment of the rolling data collecting system which executes the rolling data collecting method according to the present invention, inclusive of an applicable rolling mill.

FIG. 2 is the schematic block diagram showing the second embodiment of the rolling data collecting system which carries out the rolling data collecting method according to the invention, inclusive of an applicable tandem rolling mill. at Here, the tandem rolling mill is fundamentally the same as the one used in the first embodiment, and a single difference is that the rolling data measuring device the data of which the measuring point decision means 10 refers to is located at the entry side of the tandem rolling mill. The following description will be made, assuming that the rolling data measuring device is a temperature gauge.

A rolled strip 7 reaches the temperature gauge 13 before it enters the tandem rolling mill. When the rolled strip 7 reached the temperature gauge 13, it starts the measurement of the temperature of the rolled strip 7. If the temperature measurement T of the temperature gauge 13 falls in a predetermined temperature range at a preset time second, that is, the measurement satisfies the following expression (24), the measuring point decision means 10 decides a point on the rolled strip 7 locating at or passing the temperature gauge 13 as the measuring point.

$$T_{min} \leq T \leq T_{max} \tag{24}$$

where $T_{min}$: predetermined lower limit of temperature

T: measurement of temperature $T_{max}$: predetermined higher limit of temperature.

For example, in the case where the preset time second is 0 second, when the measurement at 0 second satisfies the above expression (24), the point on the rolled strip 7 just passing the temperature gauge 13 is decided as the measuring point.

Further, measuring point decision signals are issued at a preset period for confirmation. And as long as the measurements by the temperature gauge 13 are continuously satisfying the expression (24), the rolling data are continuously collected for control purpose and stored in memory. There may be such four kinds of cyclic period to be conceived as follows in a), b), c) and d):

a) Duration of time until the rolled strip 7 reaches the sixth stand 6 from the first stand 1.

b) Duration of time until the rolled strip 7 reaches the rolling data measuring device (not shown) installed at the delivery side of the tandem rolling mill from the first stand 1.

c) Duration of time until the rolled strip 7 reaches the sixth stand 6 from the rolling data measuring device (not shown) installed at the entry side of the tandem rolling mill or the temperature gauge 13.

d) Duration of time until the rolled strip 7 reaches the rolling data measuring device (not shown) installed at the entry side of the tandem rolling mill, or until the rolled strip 7 reaches the rolling data measuring device (not shown) installed at the delivery side of the tandem rolling mill from the temperature gauge 13.

After the measuring point is decided, the tracking means 11 and the rolling data collecting means 12 carry out the same operations as the first embodiment.

Figure 3:
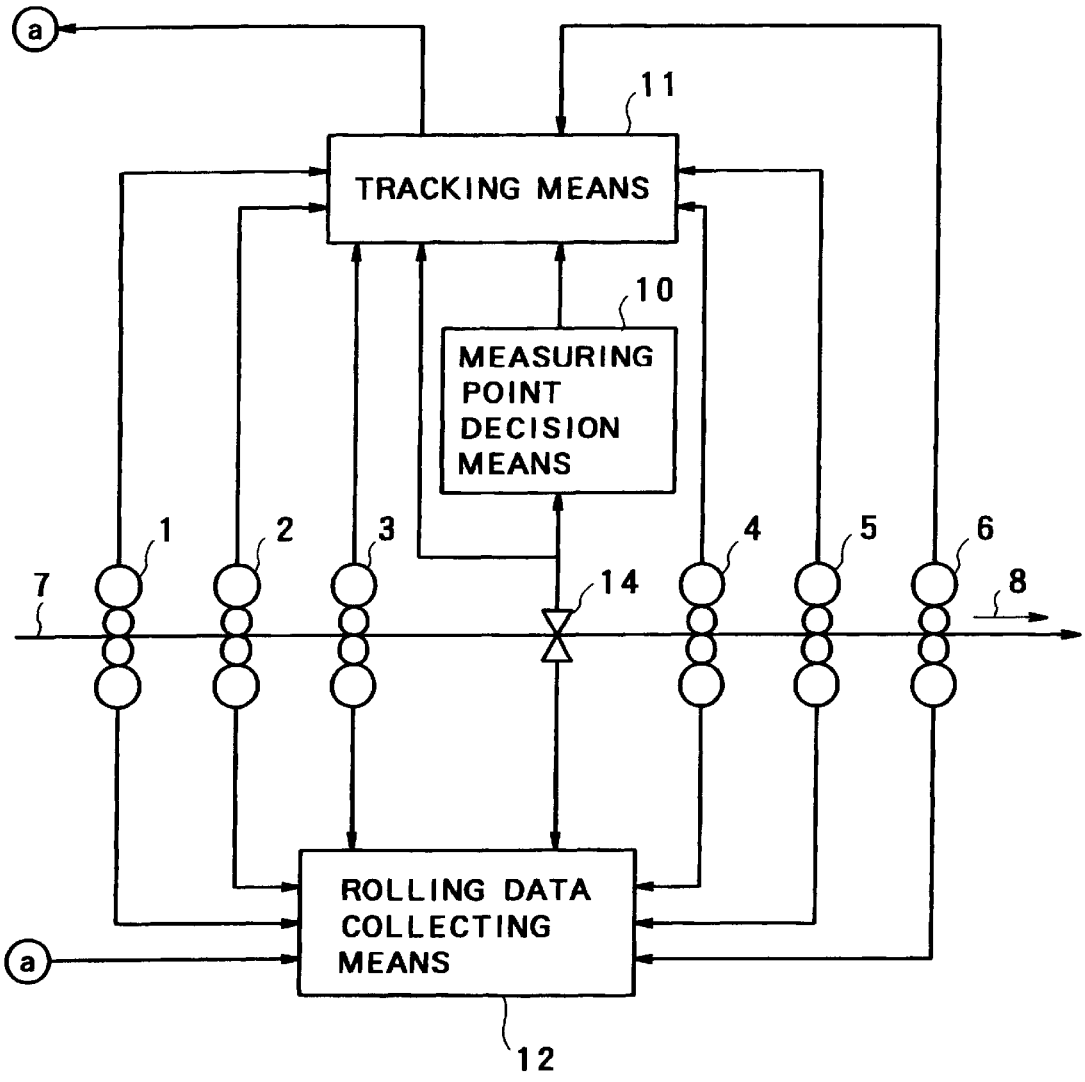
FIG. 3 is the schematic block diagram showing the third embodiment of the rolling data collecting system which executes the rolling data collecting method according to the present invention, inclusive of an applicable rolling mill.

FIG. 3 is the schematic block diagram showing the third embodiment of the rolling data collecting system which carries out the rolling data collecting method according to the invention, inclusive of an applicable tandem rolling mill. Here, the tandem rolling mill is fundamentally the same as the ones used in the first and second embodiments, and a single difference is that the temperature gauge 13 the data of which the measuring point decision means 10 refers to is located between roll stands. The operation of the third embodiment is similar to the one of the second embodiment (thus omitting the description), excepting that the rolling data measuring device 14 the data of which the measuring point decision means 10 refers to is located at a different position.

Figure 4:
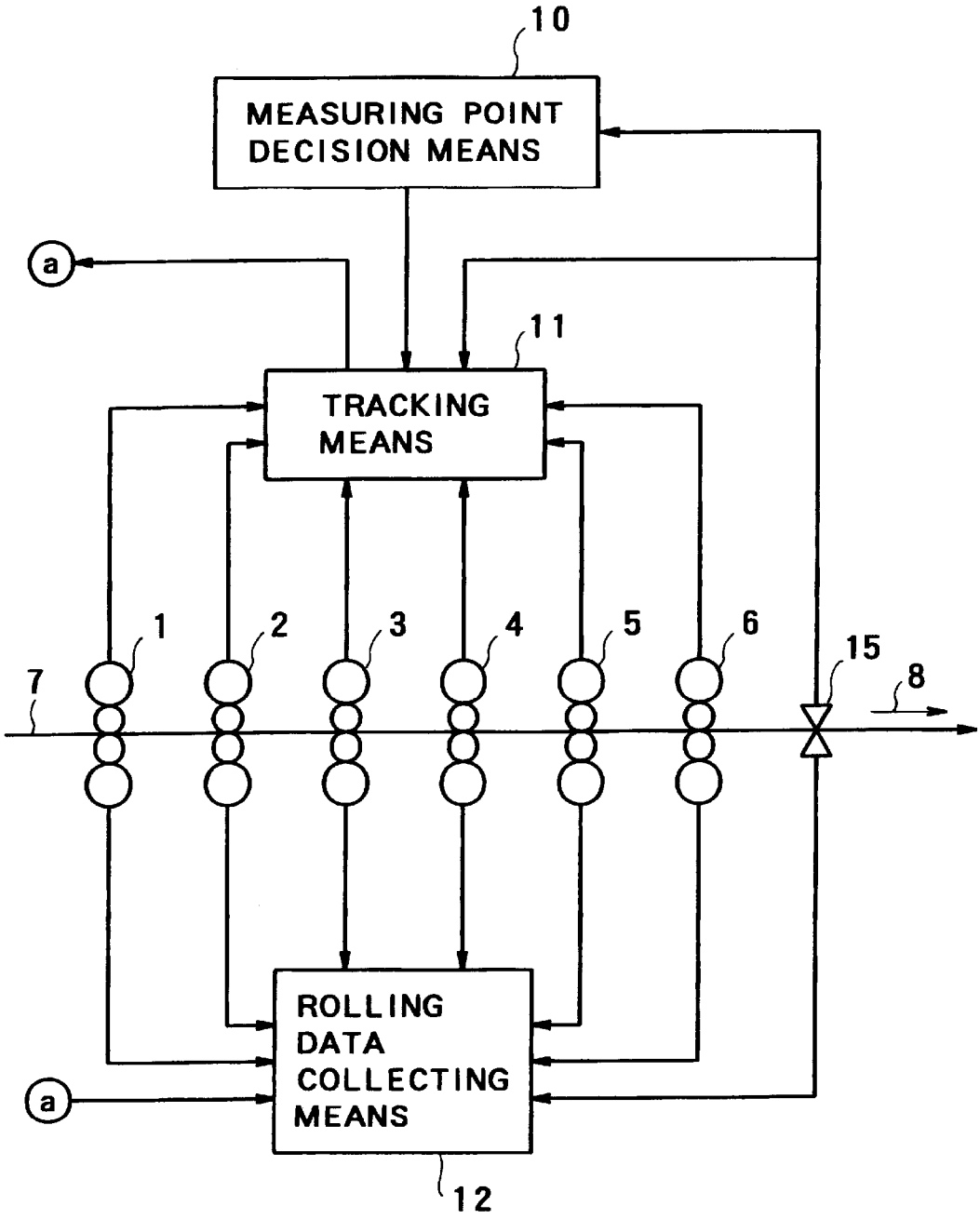
FIG. 4 is the schematic block diagram showing the fourth embodiment of the rolling data collecting system which executes the rolling data collecting method according to the present invention, inclusive of an applicable rolling mill.

FIG. 4 is the schematic block diagram showing the fourth embodiment of the rolling data collecting system which carries out the rolling data collecting method according to the invention, inclusive of an applicable tandem rolling mill. Here, the tandem rolling mill is fundamentally the same as the ones used in the first, second and third embodiments, and a single difference is that the temperature gauge 13 the data of which the measuring point decision means 10 refers to is located at the delivery side of the tandem rolling mill. The operation of the fourth embodiment is similar to the ones of the second and third embodiments (thus omitting the description), excepting that the rolling data measuring device 15 the data of which the measuring point decision means 10 refers to is located at a different position.

In this connection, the above description of the embodiments are limited to the application for a tandem rolling mill, but this invention is not limited to such application. Further, in a case when the measuring point is decided based on the measurements of a rolling data measuring device located between roll stands or at the delivery side of the tandem rolling mill, a point on a rolled strip locating at the leading stand is selected as the measuring point, but a rolling data measuring device installed at the entry side of a tandem rolling mill can allow a point on the rolled strip just locating at the rolling data measuring device to be selected as the measuring point. In this connection, a rolling data measuring device to be installed between roll stands or at the delivery side of a tandem rolling mill, and a rolling data measuring device to be installed at the entry side of a tandem rolling mill must not necessary the same kind.

What is claimed is:

1. A rolling data collecting method for collecting rolling data of a rolled strip to be serially rolled by a tandem rolling mill, using a first rolling data measuring means provided at every roll stand and a second rolling data measuring means provided in the rolling line, said method comprising the steps of;

deciding a measuring point of the rolled strip using said first and second rolling data measuring means;

detecting that said measuring point has reached each stand and the installation position of said second rolling data measuring means; and collecting the rolling data measured by said first and second rolling data measuring means, every time when said measuring point has reached each stand and said second rolling data measuring means.

2. The rolling data collecting method according to claim 1, wherein the rolling data comprises one of a rolling force and a rolling temperature.

3. A rolling data collecting system comprising:

first rolling data measuring means provided at each roll stand installed from the entry side to the delivery side of the tandem rolling mill for obtaining rolling data of a rolled strip to be serially rolled;

second rolling data measuring means provided in the rolling line for obtaining rolling data of said rolled strip;

measuring point decision means for deciding a measuring point on said rolled strip for obtaining rolling data using said first and second rolling data measuring means;

tracking means for detecting that said measuring point has reached each roll stand and the installation position of said second rolling data measuring means; and rolling data collecting means for obtaining the rolling data measured by said first and second rolling data measuring means every time when said measuring point has reached each stand and the installation position of said second rolling data measuring means.

4. The rolling data collecting system as claimed in claim 3, wherein said second rolling data measuring means is installed at the delivery side of said tandem rolling mill; and said measuring point decision means decides a rolling point of said roll stand installed most upstream of the rolling line as the measuring point, when said rolled strip reached said second rolling data measuring means.

5. The rolling data collecting system as claimed in claim 3, wherein said second rolling data measuring means is installed at the delivery side of said tandem rolling mill; and said measuring point decision means decides the rolling point on said rolled strip of said roll stand installed most upstream of the rolling line as the measuring point, a preset interval of time after said rolled strip reached said second rolling data measuring means.

6. The rolling data collecting system as claimed in claim 3, wherein said measuring point decision means decides the rolling point on said rolled strip of said roll stand installed most upstream of the rolling line as the measuring point, a preset interval of time after said rolled strip reached said roll stand installed most upstream of said tandem rolling mill.

7. The rolling data collecting system as claimed in claim 3, wherein said measuring point decision means decides a point on said rolled strip a predetermined distance apart from the leading edge of said rolled strip as the measuring point.

8. The rolling data collecting system as claimed in claim 3, wherein said measuring point decision means operates to decide said decided measuring point as the first measuring point;

said measuring point decision means operates to decide a rolling point on said rolled strip of said roll stand installed most upstream of the tandem rolling mill as the second measuring point, which takes place when said first measuring point reached said second rolling data measuring means; and said operations are repeated until the rolling of said rolled strip is finished.

9. The rolling data collecting system as claimed in claim 2, wherein said measuring point decision means operates to decide said decided measuring point as the first measuring point;

said measuring point decision means operates to decide a rolling point on said rolled strip of said roll stand installed most upstream of the tandem rolling mill as the second measuring point, which takes place a predetermined interval of time after said first measuring point reached said second rolling data measuring means; and said operations are repeated until the rolling of said rolled strip is finished.

10. The rolling data collecting system as claimed in claim 3, wherein said tracking means follows the track of said measuring point on a rolled strip, using, at least, roll diameters and forward slips and pulse values generated by pulse generators connected to motor s driving said roll stands.

11. The rolling data collecting system as claimed in claim 3, wherein said tracking means follows the track of said measuring point on a rolled strip, using roll diameter, forward slip and pulse values generated by pulse generators connected to the motor driving said final roll stand, as well as the strip thickness at the delivery side of said final roll stand and the thickness of rolled strip at a measuring point locating at the delivery side of said final roll stand.

12. The rolling data collecting system as claimed in claim 3, wherein when said tracking means judged that said measuring point on the rolled strip reached said roll stand, said tracking means decides a distance how far said measuring point on the rolled strip advanced from the most upstream roll stand, using the sheet thicknesses at the entry and delivery sides of said final roll stand.

13. The rolling data collecting system as claimed in claim 3, wherein said tracking means corrects its tracking position for said measuring point on the rolled strip, using a distance how far said measuring point on the rolled strip advanced a from the most upstream roll stand.

14. The rolling data collecting system as claimed in claim 3, wherein said tracking means decides probable intervals of time when said measuring point reaches said roll stands and said second rolling data measuring means, using the peripheral speed and forward slip of the roll, the distances between roll stands, and the distances from said roll stands and said second rolling data measuring means, and said tracking means sets the reaching interval of time to a timer so as to keep the track of said measuring point on the rolled strip.

15. The rolling data collecting system as claimed in claim 3, wherein said second rolling data measuring means is installed at the entry side of said tandem rolling mill; and when the measurements of said rolled strip by said second rolling data measuring means fall in a preset range for a preset interval of time, said measuring point decision means decides a point on the rolled strip locating at said second rolling data measuring means as the measuring point.

16. The rolling data collecting system as claimed in claim 15, wherein in the case when the measurements of said rolled strip by said second rolling data measuring means continues to fall in a preset range after the decision of said measuring point is made, said measuring point decision means decides a point on the rolled strip locating at said second rolling data measuring means as the measuring point, at a preset cycle period.

17. The rolling data collecting system as claimed in claim 3, wherein said second rolling data measuring means is installed between said roll stands; and when the measurements of said rolled strip by said second rolling data measuring means fall in a preset range for a preset interval of time, said measuring point decision means decides a rolling point on the rolled strip locating at said most upstream roll stand as the measuring point.

18. The rolling data collecting system as claimed in claim 17, wherein in the case when the measurements of said rolled strip by said second rolling data measuring means continues to fall in a preset range after the decision of said measuring point is made, said measuring point decision means decides a point on the rolled strip locating at said most upstream roll stand as the measuring point, at a preset cycle period.

19. The rolling data collecting system as claimed in claim 3, wherein said second rolling data measuring means is installed at the delivery side of said tandem rolling mill; and when the measurements of said rolled strip by said second rolling data measuring means fall in a preset range for a preset interval of time, said measuring point decision means decides a rolling point on the rolled strip locating at said most upstream roll stand as the measuring point.

20. The rolling data collecting system as claimed in claim 19, wherein in the case when the measurements of said rolled strip by said second rolling data measuring means continue to fall in a preset range after the decision of said measuring point is made, said measuring point decision means decides a point on the rolled strip locating at said most upstream roll stand as the measuring point, at a preset cycle period.

21. The rolling data collecting system as claimed in claim 3, wherein said second rolling data measuring means includes at least one of a strip crown meter, a temperature gauge, a sheet thickness meter and a flatness meter.

22. The rolling data collecting system according to claim 3, wherein the rolling data comprises one of a rolling force and a rolling temperature.

* * * * *